United States Patent [19]

Aoyama et al.

[11] Patent Number: 4,523,164

[45] Date of Patent: Jun. 11, 1985

[54] CIRCUIT BREAKER

[75] Inventors: Youichi Aoyama; Akira Takeuchi; Masaru Ohmuro; Yasuo Ichimura, all of Kadoma, Japan

[73] Assignee: Matsushita Electric Works, Ltd., Osaka, Japan

[21] Appl. No.: 634,692

[22] Filed: Jul. 26, 1984

[30] Foreign Application Priority Data

Jul. 31, 1983 [JP] Japan ..... 58-140180

[51] Int. Cl.[3] ..... H01H 75/10; H01H 77/06

[52] U.S. Cl. ..... 335/38; 335/16; 335/174

[58] Field of Search ..... 335/38, 14, 15, 16, 335/172, 174, 22, 25

[56] References Cited

U.S. PATENT DOCUMENTS 3,469,216 9/1969 Shiraishi ..... 335/16

4,281,303 7/1981 Heft ..... 335/16

*Primary Examiner*—Harold Broome

*Attorney, Agent, or Firm*—Burns, Doane, Swecker & Mathis

[57] ABSTRACT

A circuit breaker capable of breaking an associated circuit when an overcurrent higher than a rated current keeps flowing through the breaker or upon a short-circuit current. Electric power path in the breaker is partly inserted through an arm of a magnetic material and holding a movable contactor plate of make-and-break contact means, an armature means is provided as pivoted at one end to the holding arm, and a tension spring means is provided between the other end of the armature means and the movable contactor plate to provide a contact pressure. The overcurrent flowing through the path causes a magnetic force to be induced in the holding arm, whereby the armature means is rotated to change the direction in which the force of the tension spring means acts on the movable contactor plate and the latter breaks the contact means.

8 Claims, 8 Drawing Figures

CIRCUIT BREAKER

TECHNICAL BACKGROUND OF THE INVENTION

This invention relates to a circuit breaker which can break an associated circuit when an overcurrent higher than a rated current keeps flowing.

The circuit breaker of the kind referred to comprises a make-and-break contact means including fixed and movable contacts, a manual make-and-break means for manually driving the movable contact to make and break the contacts, means for detecting an overcurrent, and a trip means for urging the manual make-and-break means to be shifted into tripped state as actuated in response to the detection by the detecting means of the overcurrent so as to forcibly break the contact means.

DISCLOSURE OF PRIOR ART

Various types of circuit breakers have been so far suggested, and one of them which is structurally related to the present invention is disclosed in, for example, U.S. Pat. No. 3,469,216, wherein a movable contactor plate carrying a movable contact is provided to be rockable through a manual contact make-and-break means and the movable contact is provided to be separately contacted with a fixed contact so that, when an overcurrent occurs, a trip means causes the make-and-break means to be forcibly brought into its tripped state to break the contacts. In this breaker, however, there has been such a drawback that the forcible contact break cannot be attained unless a sufficiently large tripping force is provided, that is, when the overcurrent is not of a considerably high level.

In order to eliminate the above drawback, it is necessary to employ a complex link mechanism utilizing the leverage or the like and thus it has been demanded to provide a circuit breaker which can effectively achieve the tripping operation with a simple arrangement even when the overcurrent is of a relatively small level.

TECHNICAL FIELD

A primary object of the present invention is, therefore, to provide a circuit breaker which can provide a sufficiently large contact pressure of the movable contact with respect to the fixed contact, and is still capable of opening the contacts at a high speed even with a relatively small tripping force generated by a predetermined overcurrent higher than a rated current to achieve a high speed circuit breaking that results in a remarkably improved current limiting effect of the breaker.

This object of the present invention can be achieved by provisions of an armature pivotably supported by a yoke which forms a path of magnetic flux generated by the overcurrent so that the armature can be attracted to the yoke due to a magnetic force induced in the yoke and movable contactor plate coupled to the yoke, a tension spring means disposed between the movable contactor arm and the armature so as to bias the arm in reverse directions with respect to a dead point of armature-pivoting provided by the biasing force of the means, and a further tension spring means disposed between the armature and the yoke for normally biasing the armature towards the yoke. With this arrangement, the biasing forces of the both tension spring means are caused to act on the armature in addition to the magnetic attractive force of the yoke specifically at the time when the armature pivots beyond the dead point, so that the movable contactor plate can break the contacts at a higher speed.

Other objects and advantages of the present invention shall become clear from the following description of the invention detailed with reference to an embodiment illustrated in accompanying drawings.

Figure 1:
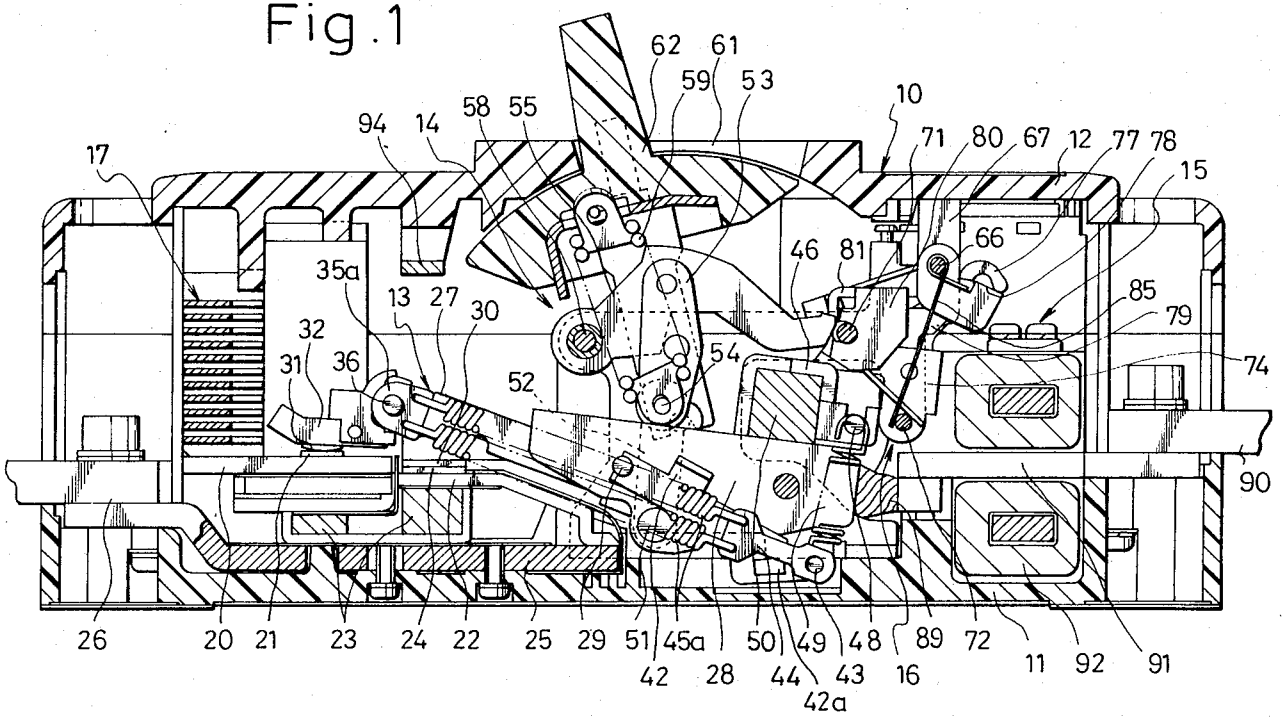
FIG. 1 is an elevation partly in section of a circuit breaker according to the present invention for showing its interior structure in a "make" state of the make-and-break contact means achieved by a manual make-and-break means.

While the present invention shall now be described with reference to a preferred embodiment shown in the drawings, it should be understood that the intention is not to limit the invention only to the particular embodiment shown but rather to include all alterations, modifications and equivalent arrangements possible within the scope of appended claims.

DISCLOSURE OF THE PREFERRED EMBODIMENT

Figure 2:
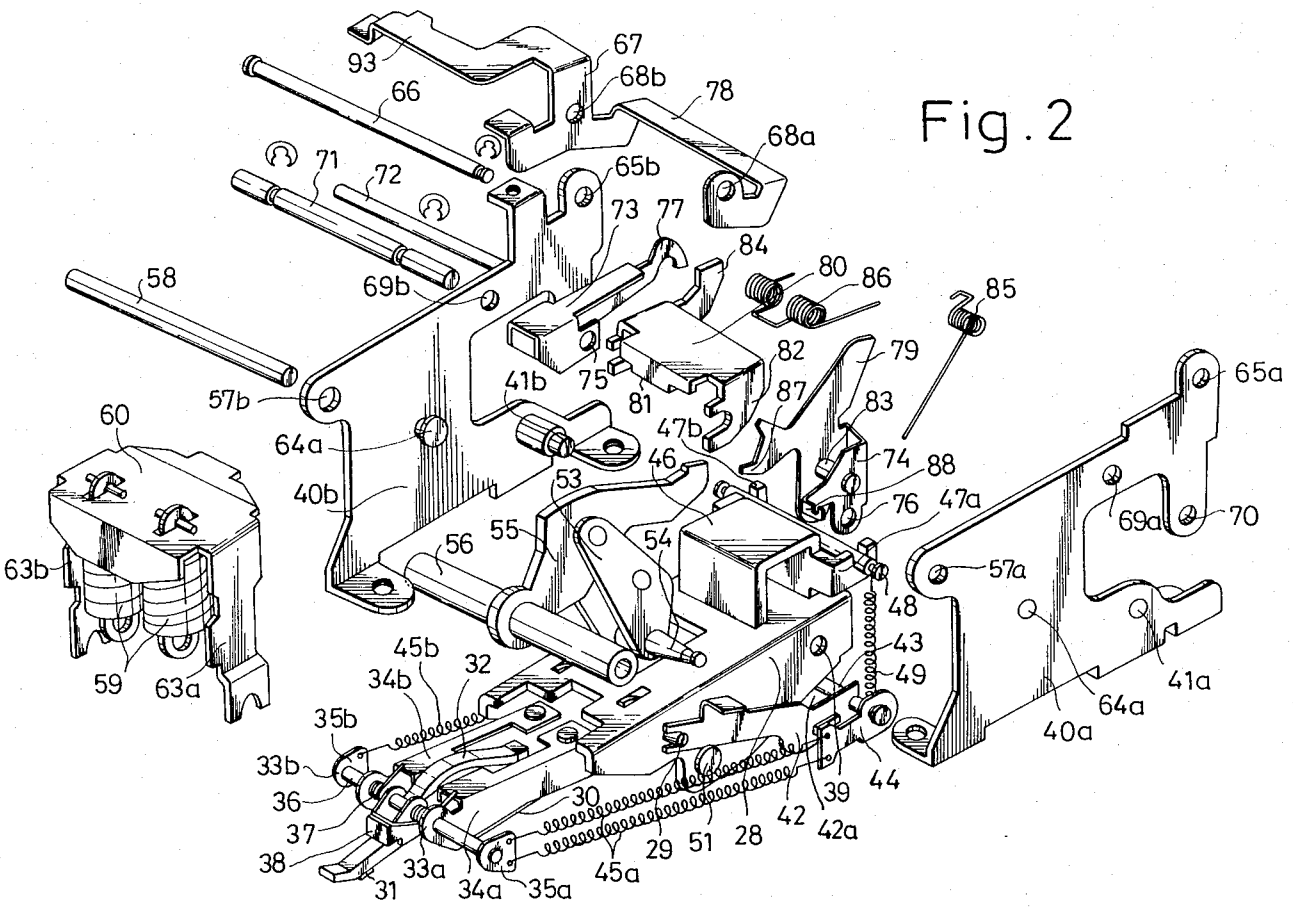
FIG. 2 is a perspective view as disassembled of main constituent members of the circuit breaker of FIG. 1.

Referring to FIGS. 1 and 2, a circuit breaker 10 includes a housing which comprises a base 11 and a cover 12 mounted on the base and, in the housing, there are arranged a make-and-break contact means 13, a manual make-and-break means 14 operably coupled to the contact means 13, an overcurrent detecting means 15, a responsive means 16 operably coupled to the detecting means to be responsive to the detection of the overcurrent for urging the manual make-and-break means as well as the contact means into their tripped state, and an arc suppressing means 17 disposed in the vicinity of the contact means 13.

The make-and-break contact means 13 includes a fixed contactor plate 20 made to be of multilayered structure which provides a sufficient strength with respect to generated arc, and this fixed contactor plate 20 is provided on its top surface with a arcing fixed contact 21. Further, the fixed contactor plate 20 has an extended fixed-contactor plate 22 projecting out of a part of the multilayered structure substantially towards the central part of the bottom face of the base 11, the both contactor plates 20 and 22 are fixedly mounted at their base portion onto a yoke 23 arranged to form a magnetic path which drives the generated arc towards the arc suppressing means 17, and the extended fixed-contactor plate 22 is provided on the upper face of its base portion adjacent the plate 21 with a main fixed contact 24 while the other extended end of the plate 22 is coupled to a connecting terminal plate 25 which extends along the bottom surface of the base 11 and in a direction opposite to the extended fixed-contactor plate 22, that is, towards one longitudinal end of the base 11 so as to form a substantially U-shape together with the extended fixed-contactor plate 22 in the elevation of FIG. 1, and the connecting terminal plate 25 is also connected at the particular end of the base 11 to a power-source side terminal 26 which extends to the exterior of the base 11.

A main movable contactor plate 27 forming a part of the make-and-break contact means 13 is held by a holding arm 28 of a magnetic material and thus capable of acting as a yoke substantially reverse U-shaped in section, as pivoted to a pivot pin 29 of the holding arm 28 to be vertically rockable at an extended end of the plate 27 on the lower face of which a main movable contact 30 is secured to be contactable with the main fixed contact 24, while on the upper surface of the extended end of the plate 27 an arcing movable contactor 32 is secured to further longitudinally extend from the plate 27 and this contactor 32 projects diagonally upwardly toward the arc suppressing means 17. The contactor 32 carries at its lower face an arcing movable contact 31 contactable with the arcing fixed contact 21. Also mounted on the main movable contactor plate 27 as pin-connected thereto are pin-supporting plates 34*a* and 34*b* which has forwardly projecting lugs 33*a* and 33*b*, a supporting pin 36 is held across the lugs 33*a* and 33*b* as passed therethrough, and each of flange plates 35*a* and 35*b* is fixed to each projected end of the pin 36. In the present embodiment, the arcing movable contactor 32 is of an arch shape and extends beneath the supporting pin 36 to project forwardly. The contactor 32 is also engaged at its top face to an up-movement restraining member 38 which is pivotably supported on the supporting pin 36 and is subjected to a resilient force of a spring 37 mounted about the supporting pin 36.

On the other hand, the holding arm 28 itself is pivotably provided between a pair of side frames 40*a* and 40*b*. Referring specifically to FIG. 2, projections 41*a* and 41*b* provided respectively on the opposing surfaces of the side frames 40*a* and 40*b* are fitted from both sides of the arm 28 into engaging holes 39 (only one of which is seen in the drawing) formed in side walls of the holding arm 28 adjacent the rearward end of the arm. The side frames 40*a* and 40*b* are screw-fastened at their lower ends to the inner bottom surface of the base 11 so as to stand parallelly upright within the housing. A pair of parallelly extending armatures 42 (only one is seen) of a magnetic material are pivotably coupled to the side walls of the holding arm 28, engaging endwise notches made in one end of the armatures to laterally projected ends of the pivot pin 29 out of the side walls of the arm 28 adjacent its forward end, so as to be adjustable in respect of positional relationship, while the other ends of the armatures 42 are coupled to each other below the rearward end of the arm 28 by means of an attraction cross-bar 42*a* of a magnetic material. An interlocking pin 43 is further engaged in endwise notches made in the other ends of the armatures 42 also across them. The interlocking pin 43 carries as fixed to both projected ends a pair of flange plates 44 (only one is seen), and preferably two pairs of tension springs 45*a* and 45*b* are hung respectively between each of the flange plates 44 and each of the foregoing flange plates 35*a* and 35*b* of the supporting pin 36 of the main movable contactor plate 27. Further, a hollow interlocking projection 46 is provided on the rear end surface of the holding arm 28, lugs 47*a* and 47*b* respectively having an upward open notch are extended rearward from the interlocking projection 46, a holding pin 48 is fitted across in the notches of the lugs 47*a* and 47*b*, and a pair of tension springs 49 (only one is seen) are hung respectively between each projected end of the holding pin 48 and each projected end of the interlocking pin 43 so that the armatures 42 are resiliently biased by the tension springs 45*a*, 45*b* and 49 in different directions and, when a line connecting between the supporting pin 36 and the interlocking pin 43 shifts in either contact make or break direction beyond the pivot pin 29 of the main movable contactor plate 27, the pin acting as a dead point of the resilient force of the springs 45*a* and 45*b*, the armatures 42 reverse the rocking movement of the main movable contact plate 27. In the event where a plurality of circuit breaker units are arranged in parallel for multiple use, an interlocking bar 50 is inserted across through the respective interlocking projections 46 of the respective units so that an overcurrent detected in one of the units will cause the contacts of other units to be broken simultaneously.

Referring to the manual make-and-break means 14, the holding arm 28 is coupled through a linkage rod 51 to lower links 52 (shown by broken line in FIG. 1) connected through a linkage pin 54 to a pair of upper links 53 which are pivotably connected to the central portion of a tripping arm 55 substantially horizontally extending parallelly between the side frames 40*a* and 40*b*, and this tripping arm 55 is pivotable about a sleeve 56 transversely secured to an end of the arm 55 and aligned with a pair of opposing through-holes 57*a* and 57*b* formed in the respective side frames, to which the sleeve 56 is mounted by a shaft 58 passed through the sleeve and holes 57*a* and 57*b*. A pair of return springs 59 are hung between projected ends of the linkage pin 54 and the central portion of a U-shaped handle fitting 60 fixedly mounted to a handle 62 which partly extrudes out of a slot 61 made in the cover 12. The handle fitting 60 is provided in downward extended ends of legs 63*a* and 63*b* with notches which are fitted to inward extrusions 64*a* and 64*b* on the respective opposing surfaces of the side frames 40*a* and 40*b*. When the handle 62 is rotated anticlockwise in the drawing in a state where the other end of the tripping arm 55 is held stationary at a fixed position, the lower and upper links 52 and 53 are made to be in the longest linkage state in which the holding arm 28 is rotated down about the pivoting projections 41*a* and 41*b*, whereby the movable contacts 30 and 31 of the main movable contactor plate 27 and arcing movable contactor 32 are brought into contact with the main and arcing fixed contacts 24 and 21, respectively, to make the contact means. Similarly, when the handle 62 is shifted in a clockwise direction, the contact means is broken.

Referring to the tripping means 16, a holding shaft 66 is mounted across the side frames 40*a* and 40*b* as inserted into opposing through-holes 65*a* and 65*b* provided in the upper corners of the side frames 40*a* and 40*b*, for holding an overcurrent responsive lever member 67 having through-holes 68*a* and 68*b* through which the shaft 66 is passed. The side frames 40*a* and 40*b* further bear at opposing two pairs of through-holes 69*a* and 69*b* and 70 (only one of latter of which is seen) upper and lower holding shafts 71 and 72, the shaft 71 being positioned between the shafts 58 and 66 while the shaft 72 being below the shaft 66, and engaging members 73 and 74 substantially U-shaped in section are pivotably born on each of these shafts 71 and 72 passed through opposing pairs of holes 75 and 76 made in both leg parts, so that the member 73 on the upper shaft 71 will be on the side closer to the side frame 40*b* and the member 74 on the lower shaft 72 will be closer to the other side frame 40*a*. An extended arm portion 77 of the engaging member 73 is engaged to an engaging portion 78 of the responsive lever member 67 on the top side of the member 73, whereas the engaging member 74 is engaged at its extended arm 79 to the inner edge of the engaging portion 78 of the member 67.

A latch member 80 is mounted on the holding shaft 71 between the engaging members 73 and 74 by fitting notches provided in respective side legs of the latch member 80 onto the shaft 71. A front tongue portion 81 of the latch member 80 is engaged to the other end of the tripping arm 55 from the top side thereof, a diagonal edge 82 of one side legs of the latch member 80 is engaged to a diagonal edge 83 of the engaging member 74 on the side of the side frame 40*a*, and an extended arm portion 84 of the other side leg of the latch 80 is engaged to the bottom surface of the engaging portion 78 of the responsive lever member 67. The holding shaft 66 carrying the responsive lever member 67 is provided with a coil spring 85 which is engaged at one end to the upper edge of an end of the responsive lever member 67 and at the other end to the lower holding shaft 72 to push down the responsive lever member 67. Further, another coil spring 86 is mounted on the holding shaft 71 carrying the latch member 80 and engaging member 73. The spring 86 is engaged at one end to the inside surface of the latch member 80, at the middle portion to a tongue portion 87 of the engaging member 74 and at the other end to the supporting shaft 72 through a lug 88 of the engaging member 74, so as to apply the spring force through the bottom of the extended arm 79 of the engagement member 74 to the engaging portion 78 of the responsive lever member 67 and also through the extended arm portion 84 of the latch member 80 to the bottom of the engaging portion 78.

On the other hand, a stranded wire 89 extended rearward within the holding arm 28 to form a part of the electric path in the breaker is connected at one end to the rear end of the main movable contactor plate 27, so that the holding arm 28 will form a part of a magnetic path acting in a manner later described when an overcurrent flows through the wire 89. The other end of the wire 89 led out of the holding arm 28 is connected to a terminal block 91 which in turn is connected to a load side terminal 90, and a detecting coil 92 of the detecting means 15 is provided around the terminal block 91. The detecting means 15 itself does not form a feature of the present invention, and thus it will be sufficient to simply refer to that the detecting means 15 rectifies a current detected by the coil 92 and determines whether or not the detected current has exceeded a predetermined level and, if so determined, the detecting means produces a tripping force through an actuating connection member (not shown) linked to the engaging member 73. The tripping force is applied through the actuating connection member to the extended arm portion 77 of the engaging member 73 in engagement with the engaging portion 78 of the responsive lever member 67 so as to push down the lever member 67, whereby the engaging member 74 is disengaged from the engaging portion 78, and the diagonal edge 83 of the engaging member 74 is separated from the diagonal edge 82 of the latch member 80. This will cause the latch member 80 to be rotated clockwise through the extended arm portion 84 and the tongue portion 81 to be disengaged from the other end of the tripping arm 55, and the particular end of the arm 55 can no more be held at the fixed position and is put in a tripped state under influence of the returning spring 59. The responsive lever member 67 has an arm 93 extended outside the housing for allowing a test tripping force may be applied through this extended arm 93 to the member 67.

The arc suppressing means 17 includes known deion grids disposed above the fixed contactor plate 20 so as to attract, divide, cool and suppress an arc generated between the arcing fixed and movable contacts 21 and 31 at the time of breaking the contact means 13 while the generated arc is subjected to a magnetic driving force of the yoke 23.

The cover 12 of the housing is provided on the inner surface with a projection 94 for restraining the upward movement of the movable side part of the contact means.

Figure 3:
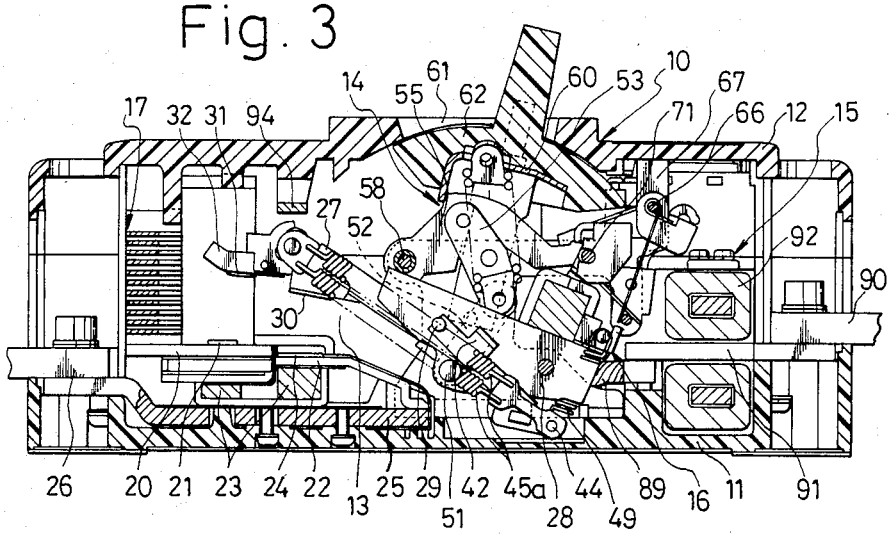
FIG. 3 is an elevation similar to FIG. 1 of the breaker but in a "break" state of the contact means achieved by the manual make-and-break means.

The operation of the circuit breaker according to the present invention shall be detailed. When the handle 62 of the manual make-and-break means 14 is shifted to a position shown in FIG. 1, the upper and lower links 53 and 52 are put into the most stretched state, and the holding arm 28 is thereby lowered. Therefore, the main movable contactor plate 27 and movable contactor 32 integral therewith are lowered so that the main movable contact 30 and arcing movable contact 31 will come into contact with the main fixed contact 24 and arcing fixed contact 21, respectively, whereby the make-and-break contact means 13 is closed, upon which the resilient forces of the tension springs 45*a* and 45*b* are applied respectively between the main movable and fixed contacts 30 and 24 and between the arcing movable and fixed contacts 31 and 21, so that the contact pressure is provided between these contacts. In this case, the arcing movable and fixed contacts 31 and 21 are to achieve the contact making motion faster than that between the main contacts 30 and 24, with the aid of additionally given contact pressure of the spring 37 but, on the contrary, the contact breaking motion between the arcing contacts 31 and 21 is made slower than that between the main contacts 30 and 24 due to the spring 37. When the handle 62 is shifted clockwise from the position of FIG. 1 to a position shown in FIG. 3, the upper and lower links 53 and 52 are put into their bent state, the holding arm 28 is rotated upward, and the contact means 13 is put in a broken state.

Figure 5:
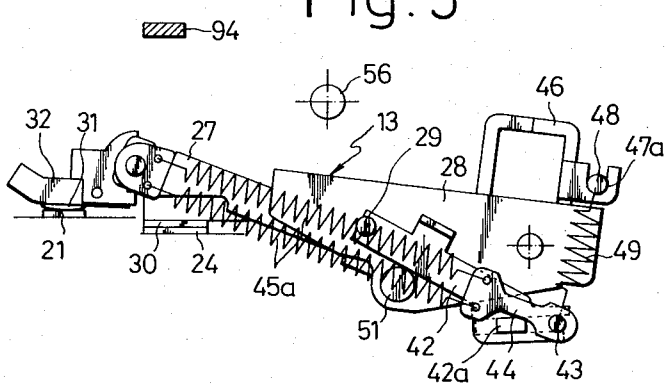
Figure 6:
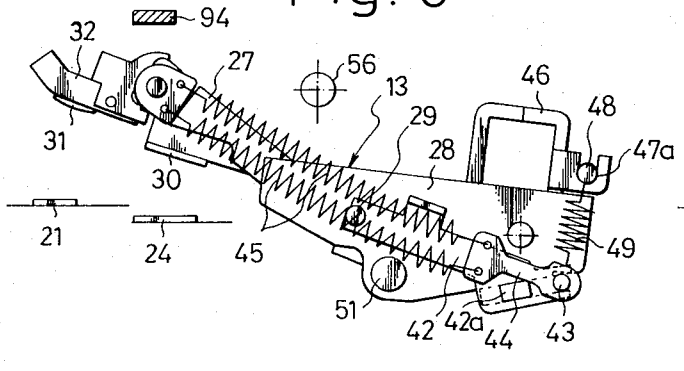

On the other hand, when an overcurrent or short-circuit current higher than a predetermined level flows between the power source side and load side terminals 26 and 90 in the "make" state of FIG. 1 of the breaker, the density of magnetic flux generated by means of the electric path 89 extended within the holding arm 28 of magnetic material becomes extremely high, which causes the armatures 42 to be attracted to the arm 28 through a magnetic path including the attraction cross-bar 42*a* and interlocking pin 43. This will cause the armatures 42 to be rotated counterclockwise about the pivot pin 29, and thus a line connecting the supporting pin 36 to the interlocking pin 43 between which the tension springs 45*a* and 45*b* are hung and passing through the centers of the tension springs 45*a* and 45*b* will becomes slightly higher than the pivot pin 29 forming the pivot point of the main movable contactor plate 27, and the contacting pressure between the arcing and main contacts will be rapidly reduced. In other words, the armatures 42 under the influence of the tensile force of the tension springs 45*a* and 45*b* will be moved as reversed with the position of the pivot pin 29 as a dead point, whereby the contact means 13 will be quickly shifted from the "make" position of FIG. 5 to the "break" position of FIG. 6, breaking the contact means 13. During the reversed movement of the armatures 42, the tension springs 49 hung between the interlocking pin 43 of the holding pin 48 also act to pull up the other end of the armature 42, and the breaking motion of the contact means 13 will be accelerated.

Figure 4:
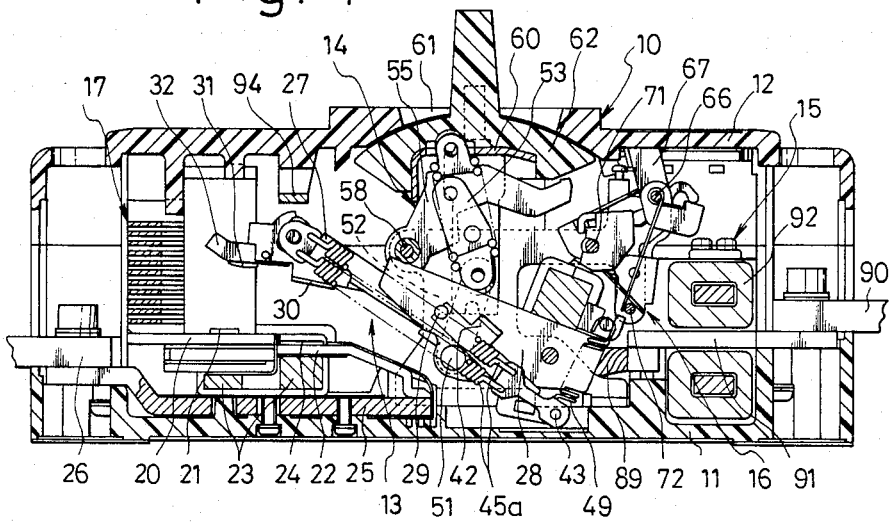
FIG. 4 is an elevation also similar to FIG. 1 of the breaker but in a state as tripped.
Figure 7:
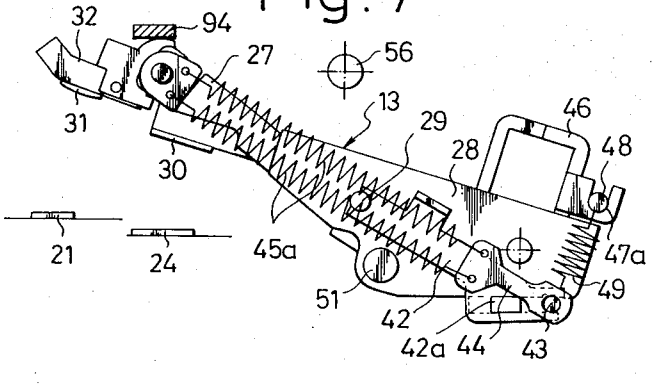
FIGS. 5 to 8 are fragmental schematic elevations showing varying relationship specifically between the movable contactor plate, armature and tension spring means in their different operating states.
Figure 8:
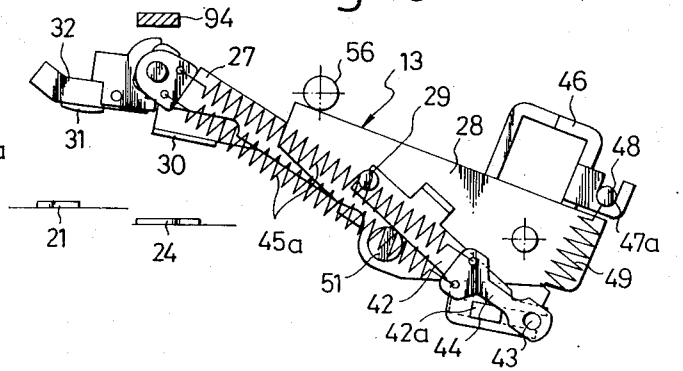

Due to that the overcurrent flows through the terminal block 91 connected to the wire 89 simultaneously with the above contact breaking motion, the overcurrent is also detected by the detection coil 92 of the detecting means 15 so that the latter generates the tripping force that pushes down the overcurrent responsive lever member 67. This will cause the latch member 80 to be disengaged from the other end of the tripping arm 55 which is thereby caused to be rotated counterclockwise under influence of the return spring 59, whereby the handle operation is disabled and the circuit breaker is put in its tripped state as shown in FIG. 4. In the tripped state, the main movable contactor plate 27 and arcing movable contactor 32 are further moved up as shown in FIG. 7 under influence of the return spring 59 through the holding arm 28 so that the main movable contactor plate 27 abuts at its top against the restraining projection 94 disposed above the plate 27 and thereby the plate 27 is rotated counterclockwise about the pivot pin 29 of the plate 27. As a result, the line connecting between the supporting pin 36 and the interlocking pin 43 is positioned lower than the pivot pin 29 as shown in FIG. 8, whereby the armatures 42 are again moved reversely under the influence of the tension springs **45*a* and 45*b*** so as to reset to their initial position.

During the foregoing break operation of the contact means, the breaking of the arcing movable and fixed contacts 31 and 24 takes place later than that of the main movable and fixed contacts 30 and 24, and the arc is generated mainly between the arcing contacts. Further, because the arc suppressing means 17 is disposed close to the arcing contacts, the arc will be effectively driven toward the arc suppressing means under additional influence of the magnetic driving force of the yoke 23 for arc suppression.

In addition, the circuit breaker according to the present invention may be modified in various manners. For example, while the electronically overcurrent detecting means has been used in the embodiment shown, the detecting means may be of any known electromagnetic plunger type. Further, though the explanation has been made with reference to the case where a plurality of circuit breaker units are combined into a circuit breaker, it will be appreciated that the circuit breaker may consist of a single circuit breaker unit, in which case the interlocking bar 50 passed through the projection 46 on the contactor holding arm 28 can be omitted.

What is claimed as our invention is:

1. A circuit breaker comprising a make-and-break contact means including a fixed contactor plate having a fixed contact and a movable contactor plate having a movable contact separably contacted with said fixed contact, means for manually making and breaking said contact means, an arm means operatively coupled to said manual make and break means for holding said movable contactor plate, an armature means pivoted at one end to said arm means, a spring means provided between the other end of said armature means and the movable contactor plate so that a line passing through said spring means lies on the contact making side with respect to a pivot point of the armature means upon contact make motion of the movable contactor plate but lies on the contact breaking side with respect to said pivot point upon contact breaking motion of the movable contactor plate, means for generating a magnetic force which causes the armature means to be rotated in its contact breaking direction when an overcurrent flows through an electric path including the contact means, and means responsive to said overcurrent for tripping the manual make-and-break means from its contact making state to a tripped state.

2. A circuit breaker according to claim 1, wherein said magnetic force generating means is energized prior to said tripping means.

3. A circuit breaker according to claim 1, wherein a spring load is applied to the other end of said armature means for rotating it in said contact breaking direction.

4. A circuit breaker according to claim 1, wherein said magnetic force generating means includes an electric wire passing through said arm means and forming a part of an electric path in the breaker, and a yoke forming at least a part of the arm means and disposed to attract said armature means which is made of a magnetic material.

5. A circuit breaker according to claim 1, wherein said arm means is provided with an engaging portion for said spring means, and said spring means is engaged to said engaging portion so that the central part of the spring means will be pulled toward said pivot point of said armature means during said contact breaking motion of said movable contactor plate.

6. A circuit breaker according to claim 4, wherein a distance between said yoke of said arm means and said armature means is adjustable.

7. A circuit breaker according to claim 3, wherein the other end of said armature means is engaged to a shaft means, one end of said spring means is engaged to said shaft means and a spring load is applied to the shaft means to rotate the other end of the armature means in said contact breaking direction.

8. A circuit breaker according to claim 7, wherein said shaft means is made of a magnetic material to form a part of said magnetic force generating means.

* * * * *